US008245428B2

(12) United States Patent
Griffin

(10) Patent No.: US 8,245,428 B2
(45) Date of Patent: Aug. 21, 2012

(54) FOREND GRIP ASSEMBLY FOR RECEIPT UPON AN UNALTERED HOST WEAPON

(75) Inventor: Todd Griffin, Miami, FL (US)

(73) Assignee: RM Equipment, Inc., Miami, FL (US)

( * ) Notice: Subject to any disclaimer, the term of this patent is extended or adjusted under 35 U.S.C. 154(b) by 763 days.

(21) Appl. No.: 11/720,567

(22) PCT Filed: Dec. 5, 2006

(86) PCT No.: PCT/US2006/046448

§ 371 (c)(1),
(2), (4) Date: May 20, 2009

(87) PCT Pub. No.: WO2007/067569

PCT Pub. Date: Jun. 14, 2007

(65) Prior Publication Data

US 2010/0031551 A1 Feb. 11, 2010

Related U.S. Application Data

(60) Provisional application No. 60/742,228, filed on Dec. 5, 2005.

(51) Int. Cl.
*F41C 23/16* (2006.01)

(52) U.S. Cl. ..... 42/72; 42/94; 89/1.42

(58) Field of Classification Search ..... 42/72, 73, 42/94, 85; 89/1.42

See application file for complete search history.

(56) References Cited

U.S. PATENT DOCUMENTS

| | | | | |
|---|---|---|---|---|
| 4,502,238 | A * | 3/1985 | Farrar et al. | 42/72 |
| 5,048,215 | A * | 9/1991 | Davis | 42/72 |
| 6,487,807 | B1 * | 12/2002 | Kopman et al. | 42/94 |
| 6,622,416 | B2 * | 9/2003 | Kim | 42/146 |
| 6,785,997 | B2 * | 9/2004 | Oz | 42/94 |
| 6,851,214 | B2 * | 2/2005 | Oz | 42/146 |
| 7,111,424 | B1 * | 9/2006 | Moody et al. | 42/72 |
| 7,121,034 | B2 * | 10/2006 | Keng | 42/71.01 |
| 7,191,557 | B2 * | 3/2007 | Gablowski et al. | 42/72 |
| 7,222,451 | B2 * | 5/2007 | Keng et al. | 42/94 |
| 7,243,454 | B1 * | 7/2007 | Cahill | 42/72 |
| 7,325,352 | B2 * | 2/2008 | Matthews et al. | 42/85 |
| 7,464,495 | B2 * | 12/2008 | Cahill | 42/72 |
| 7,559,167 | B1 * | 7/2009 | Moody et al. | 42/72 |
| 7,563,097 | B2 * | 7/2009 | Lavigna et al. | 434/16 |
| 7,584,568 | B1 * | 9/2009 | Brownlee | 42/94 |
| D607,079 | S * | 12/2009 | Moody et al. | D22/109 |
| D608,408 | S * | 1/2010 | Moody et al. | D22/109 |
| D609,768 | S * | 2/2010 | Moody et al. | D22/109 |
| 7,658,029 | B1 * | 2/2010 | Moody et al. | 42/72 |
| 7,658,030 | B2 * | 2/2010 | Moody et al. | 42/94 |

(Continued)

FOREIGN PATENT DOCUMENTS

WO WO 2004081485 A1 * 9/2004

*Primary Examiner* — Benjamin P Lee

(74) *Attorney, Agent, or Firm* — Nawrocki, Rooney, Sivertson, P.A.

(57) ABSTRACT

A weapon grip assembly for mating with a weapon without tools is provided. The assembly generally includes a handle, a weapon interface supported by the handle, and an actuator operatively engageable in furtherance of securely affixing the weapon interface to a lower portion of an unaltered hand-guard of the weapon. The weapon interface generally includes a mount body, and an actuatable locking structure reversibly extendible from the mount body via operative engagement of the actuator.

24 Claims, 17 Drawing Sheets

U.S. PATENT DOCUMENTS 7,665,241 B2 * 2/2010 Oz ..... 42/94
7,669,359 B2 * 3/2010 Kim ..... 42/124
7,685,761 B2 * 3/2010 Wu ..... 42/146
7,712,241 B2 * 5/2010 Teetzel et al. ..... 42/72
7,712,242 B2 * 5/2010 Matthews et al. ..... 42/90
D617,863 S * 6/2010 Moody et al. ..... D22/108
7,743,545 B1 * 6/2010 Moody et al. ..... 42/94
D635,216 S * 3/2011 Moody et al. ..... D22/108
7,900,390 B2 * 3/2011 Moody et al. ..... 42/72
7,909,301 B2 * 3/2011 Faifer ..... 248/440.1
7,941,960 B2 * 5/2011 Matthews et al. ..... 42/90
7,987,625 B1 * 8/2011 Moody et al. ..... 42/94
2002/0100204 A1 * 8/2002 Kim ..... 42/146
2005/0188588 A1 * 9/2005 Keng ..... 42/72
2005/0188597 A1 * 9/2005 Keng et al. ..... 42/94
2005/0241206 A1 * 11/2005 Teetzel et al. ..... 42/72
2006/0064913 A1 * 3/2006 Gablowski et al. ..... 42/72
2006/0277809 A1 * 12/2006 Moody et al. ..... 42/72
2006/0288626 A1 * 12/2006 Kim ..... 42/73
2007/0199224 A1 * 8/2007 Bentley ..... 42/72
2008/0010890 A1 * 1/2008 Vice et al. ..... 42/72
2008/0052979 A1 * 3/2008 Lee et al. ..... 42/94
2009/0038200 A1 * 2/2009 Keng ..... 42/94
2009/0045304 A1 * 2/2009 Faifer ..... 248/188.5
2009/0193702 A1 * 8/2009 Lin ..... 42/72
2009/0288323 A1 * 11/2009 Moody et al. ..... 42/72
2009/0313873 A1 * 12/2009 Roth ..... 42/72
2010/0005696 A1 * 1/2010 Moody et al. ..... 42/94
2010/0242332 A1 * 9/2010 Teetzel et al. ..... 42/72
2010/0307043 A1 * 12/2010 Moody et al. ..... 42/72
2011/0047850 A1 * 3/2011 Rievley et al. ..... 42/72
2011/0047851 A1 * 3/2011 Mock et al. ..... 42/72
2011/0179688 A1 * 7/2011 Ash et al. ..... 42/72

* cited by examiner

FOREND GRIP ASSEMBLY FOR RECEIPT UPON AN UNALTERED HOST WEAPON

This is an international patent application filed under 35 U.S.C. §363 claiming priority under 35 U.S.C. §119(e) (1), of provisional application Ser. No. 60/742,228, having a filing date of Dec. 5, 2005 and incorporated herein by reference in its entirety.

TECHNICAL FIELD

The present invention generally relates to firearms, more particularly, to a forend grip for receipt upon a host weapon, more particularly, a grip reversibly receivable within one or more spaced apart apertures of an unaltered forend of a host weapon.

BACKGROUND OF THE INVENTION

Weapons are fired with a purpose: to hit an intended target. A basic tenant of shooting is that the operator must have complete control of the weapon in order to make it perform accurately. A firm grip of the weapon is basic to achieving control thereof, and thus, accurate performance.

Because the functional characteristics of weapons, more particularly, rifles, cause them to be elongated, a forward gripping surface of a rifle is typically a long, rounded surface. Such forward gripping devices or hand holds are generally referred to as forends or forearms. The form or configuration of the surface of a forearm requires the operator to grip the rifle by positioning a hand of their outstretched arm in a palm-up fingers-spread fashion so as to cradle the forearm of the rifle in their palm, while encircling the forearm as much possible, with the digits of the hand. The diameter of the forearm is generally sized to the functional requirements of the rifle, and not the optimum gripping size for an operator.

The aforementioned described method of holding the forward control surface of the rifle is unnatural, uncomfortable, and fatiguing. To achieve the described grip, the operator must turn their lower arm away from its natural position facing the body to facing fully upwards, then partially extending the arm, and maintaining such position while gripping. This position constantly stress the muscles in the operator's lower and upper arm, and is a less-than optimal orientation or configuration for the arm to support the weight of the rifle for an extended period of time. Be that as it may, most rifles require the operator to assume this posture when carrying or using the rifle. Military users typically have their rifle in hand for many hours continuously. Likewise, hunters often engage in their activities for lengthy periods, and, sporting shooters handle their rifles for hours at a time practicing their competition skills.

Heretofore known approaches to supporting the forend of a weapon have been directed to the creation of a secondary gripping accessory, and a mounting rail attaching system to receive the secondary gripping assembly. Such special combination is known to provide the operator with a forend gripping surface more ergonomically functional, usually at a right angle to the weapon barrel.

Such grips, commonly referred as "vertical grips," are accessories which are mounted to a weapon which is prepared in advance to receive such device via the addition of an accessory-mounting rail. Commonly, the rail is attached beneath the rifle barrel after the rifle forearm (e.g., a lower portion of a hand guard) has been removed, and the rail is positioned in place of, or substituted for it, although other rail systems are known (e.g., in lieu of substituting for the lower handguard, rails are available which operatively engage a portion of a handguard, a variety of accessory devices/articles being thereafter supported, suspended, etc. from the rail of the rail system). A variety of accessory-mounting rails are offered by a number of manufacturers with several styles of vertical grips designed to attach to accessory-mounting rails generally known and available.

Although accessory-mounting rails for installation under a weapon barrel are known, in addition to being a hindrance to a universal forend grip, the host weapon requires alteration with this approach. Furthermore, most rifle models currently being manufactured are produced with a rounded forearm as the primary forward gripping surface. Thus, the lack of forward gripping surface persists for operators of all rifles with rounded forearms.

Adding an accessory-mounting rail to a weapon to provide an attachment surface for a vertical grip adds complexity to the weapon that is not required, and hardly advantageous. It alters the appearance, overall design, and arguably the functionality of the weapon.

As heretofore known vertical grip products require weapons be prepared in advance, or modified in some way to receive grip, it remains advantageous, and optimal, to provide operators thereof with an ergonomic grip which can be instantly attached to an unaltered host weapon, i.e., as it exists, without the need for tools, or disassembly of any portion of the weapon. Furthermore, it is believed advantageous to provide an interface or attachment assembly which is readily mateable and secureable with the unaltered portion of the weapon, as well as an attachment assembly, or device per se which itself is adapted or is readily adaptable to support select accessories, e.g., a target illumination device.

SUMMARY OF THE INVENTION

The grip assembly of the subject invention is a weapon support aid which, when attached to an host weapon, is positioned to depend from an underside of an unaltered forend (e.g., a lower portion of a handguard or the like), and is advantageously oriented at about ninety degrees to a barrel of the weapon. Such configuration generally results in a grip of the grip assembly depending from the forearm of the host weapon in a vertical orientation when the host weapon is held in a ready for firing condition.

The subject grip assembly attaches to the host weapon without the use of tools, hardware, etc., by engaging mating surfaces of a mounting plate of the assembly with a portion of the weapon forearm. When engaged, the operator can create and maintain a locked interference fit for the grip assembly upon the unaltered weapon's forearm by actuation of an actuator mechanism. To remove the grip assembly of the subject invention, the operator reverses the process. Taking only seconds, attaching or detaching the subject grip assembly is accomplished silently, in complete darkness, without tools, and while wearing gloves.

The assembly generally includes a handle, a weapon interface supported by the handle, and an actuator operatively engageable in furtherance of securely affixing the weapon interface to a lower portion of an unaltered handguard of the weapon. The weapon interface generally includes a mount body, and an actuatable locking structure reversibly extendible from the mount body via operative engagement of the actuator.

The subject grip assembly is configurable to attach to forearms of a variety of weapons, more particularly, those commonly known as the M16 rifle, the M4 rifle, and the AR-15 rifle. The grip assembly of the subject invention will also attach to these style forearms when these forearms are attached to other makes and models of host weapons. Furthermore, and as should be readily appreciated in connection to the subsequent detailed description, modifications in the nature/configuration of mating services of mounting plate permit the otherwise novel features of the grip assembly to provide enhanced forend gripping to other known styles of host weapon, more particularly forearms thereof. More specific features and advantages obtained in view of those features will become apparent with reference to the drawing figures and DETAILED DESCRIPTION OF THE INVENTION.

DETAILED DESCRIPTION OF THE INVENTION

Figure 1:
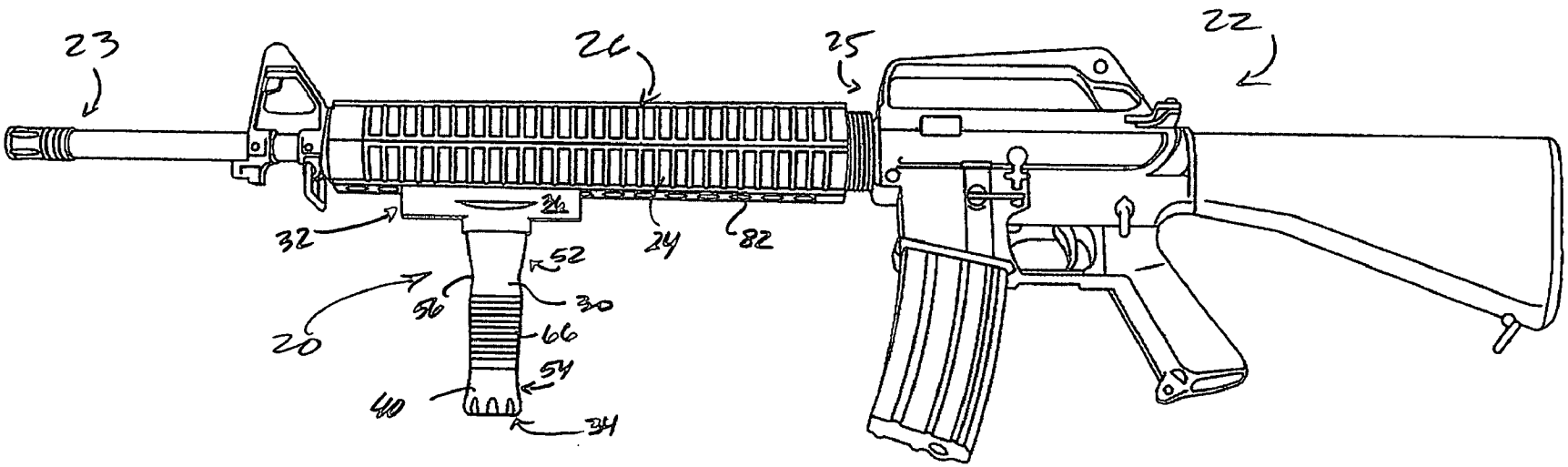
FIG. 1 illustrates a weapon grip assembly of the subject invention operatively engaged with an unaltered forend of a weapon.

A grip assembly 20 of the subject invention is shown in FIG. 1, more particularly, the assembly 20 is illustrated operatively united to a weapon 22, i.e., a host weapon, more particularly still, to a lower portion 24 of an unaltered forend 26, namely the CAR forend of a Bushmaster M4 carbine. The FIG. 1 assembly per se is the subject of FIGS. 2-5; the assembly and forend relationships the subject of FIGS. 6-10; and, an advantageous adaptation thereof the subject of FIGS. 11-13. Functionally advantageous, non-limiting alternate assemblies are depicted in FIGS. 14-16 on the one hand, and FIG. 17 on the other hand, more particularly, alternate weapon interface structures for an M16 forearm and HK-G36 forearm, respectively.

Figure 2:
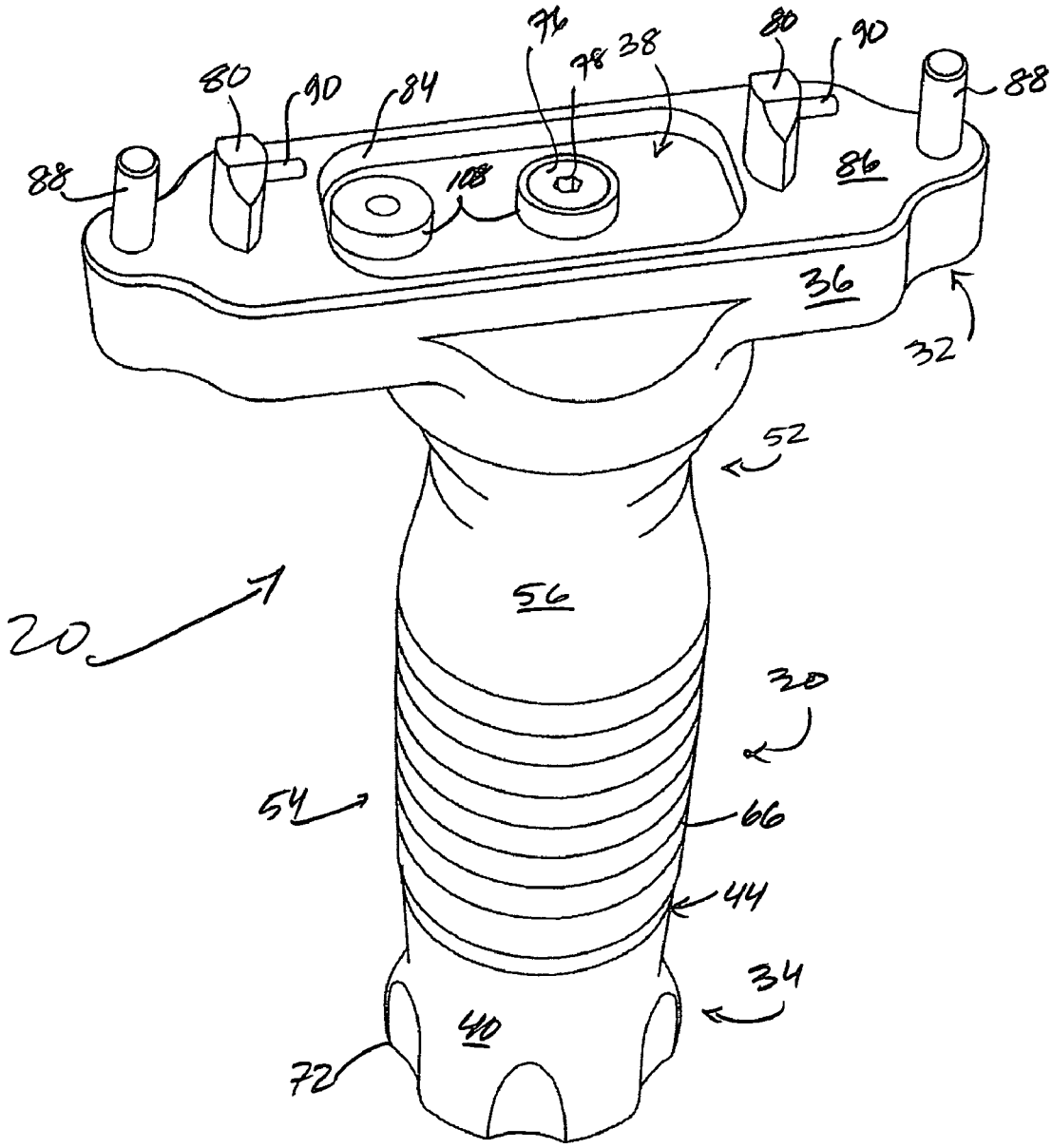
FIG. 2 depicts, in perspective from above and to one side, the weapon grip assembly of FIG. 1, in a readied condition for integration with an unaltered weapon forend.
Figure 3:
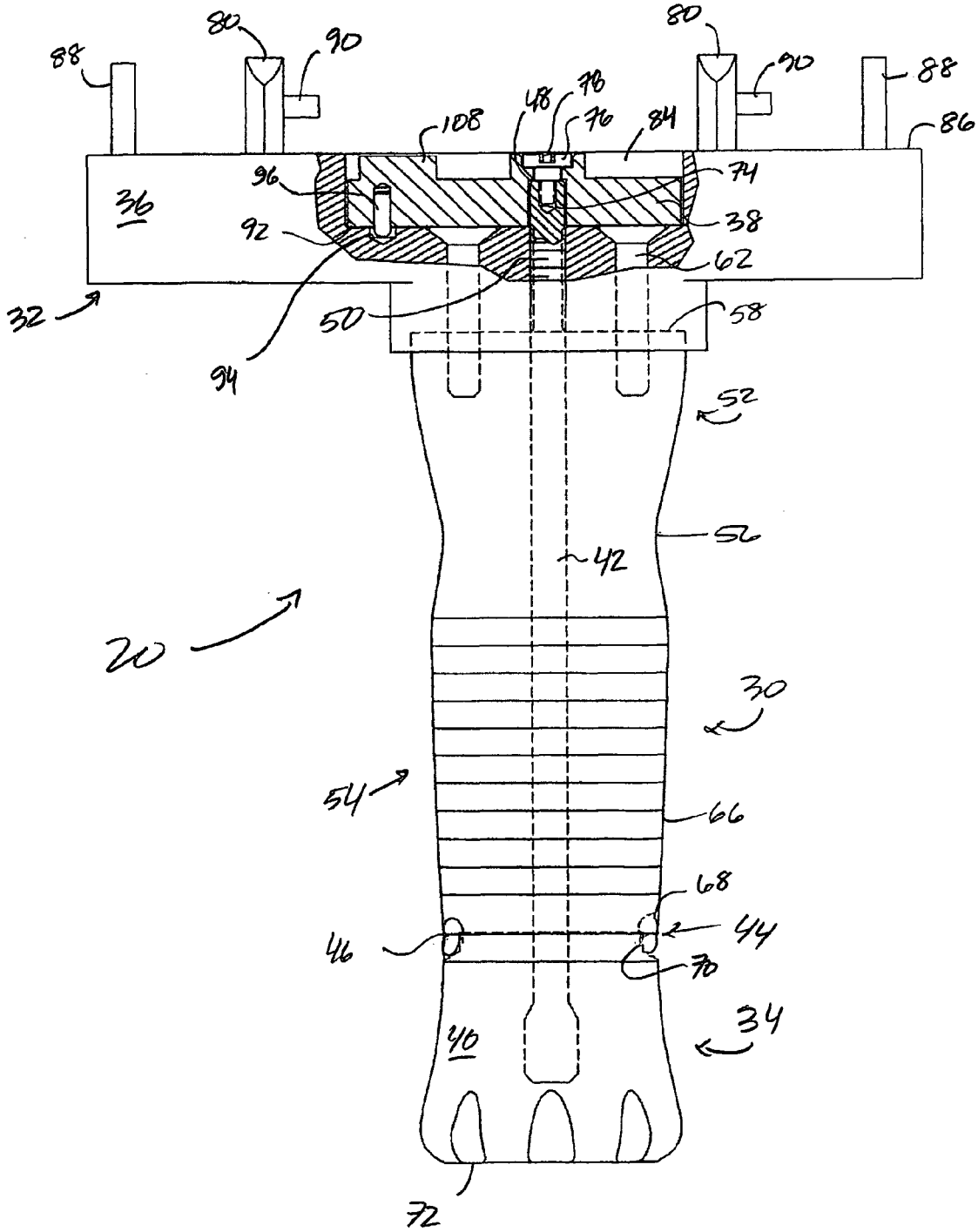
FIG. 3 is a side elevation of the assembly of FIG. 2, parts broken away to vertical orthographic section on centerline.
Figure 4:
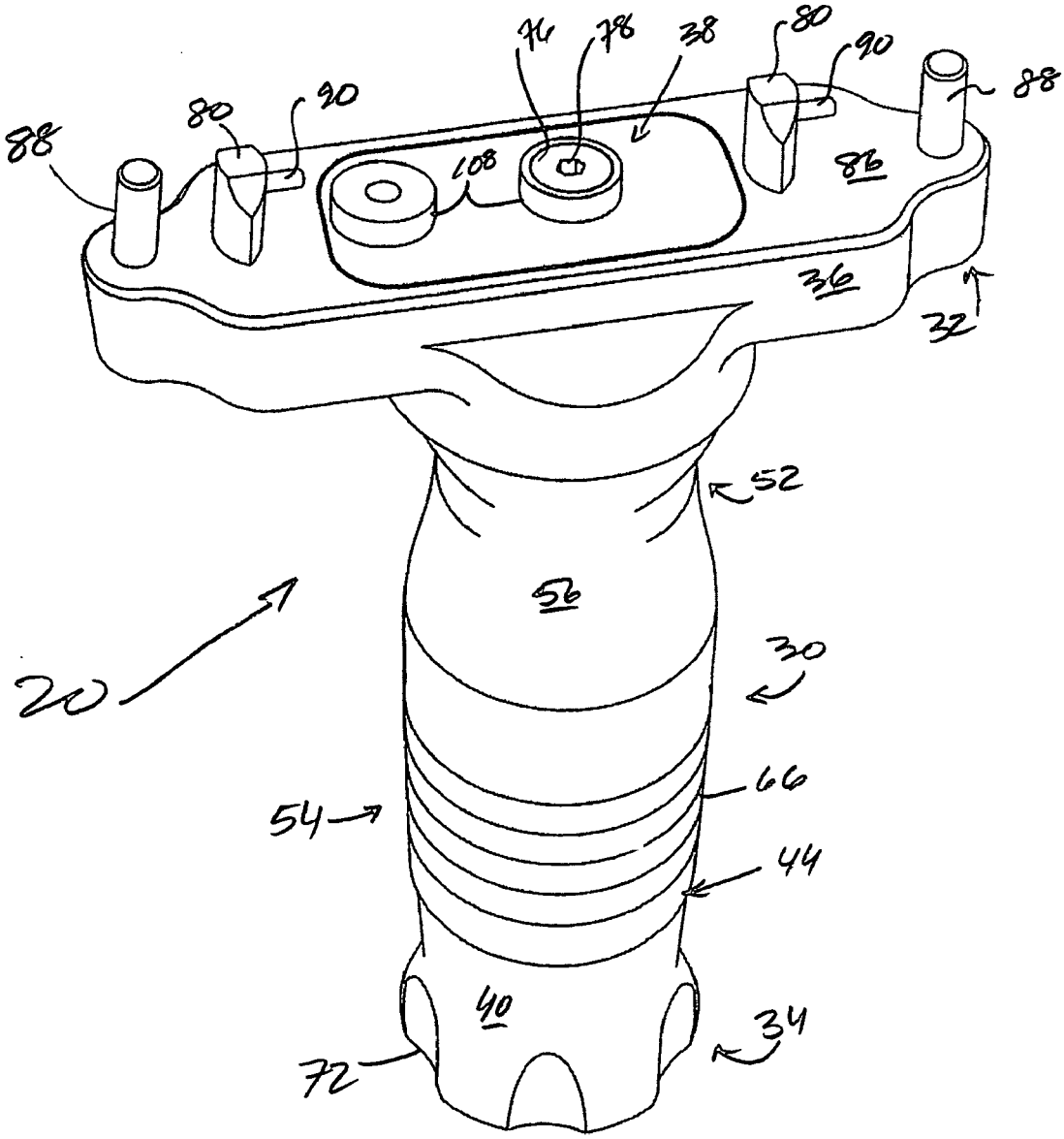
FIG. 4 is a view as FIG. 2, a center lug thereof shown in a state of advancement.
Figure 5:
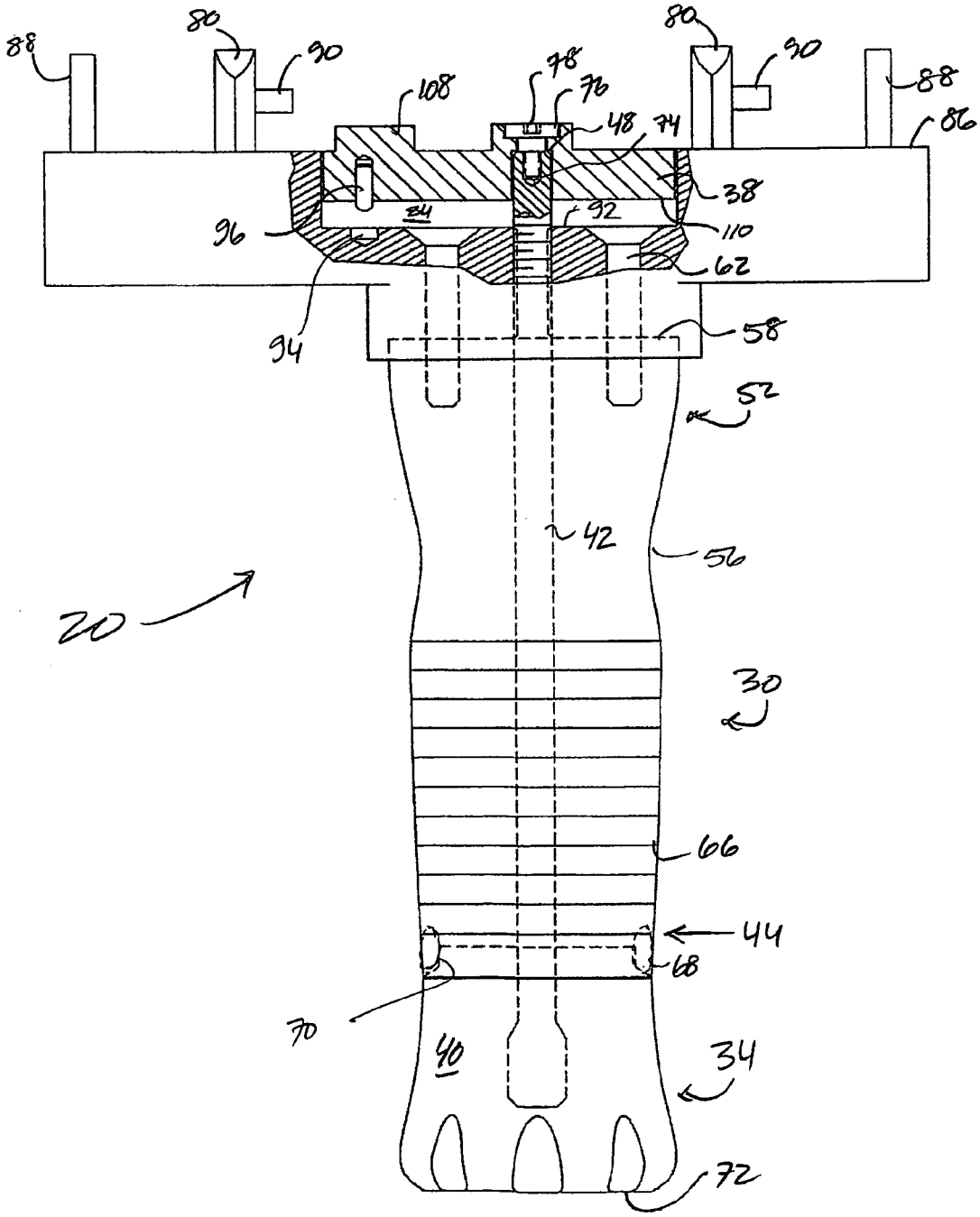
FIG. 5 is a side elevation of the assembly of FIG. 4, parts broken away to vertical orthographic section on centerline.
Figure 6:
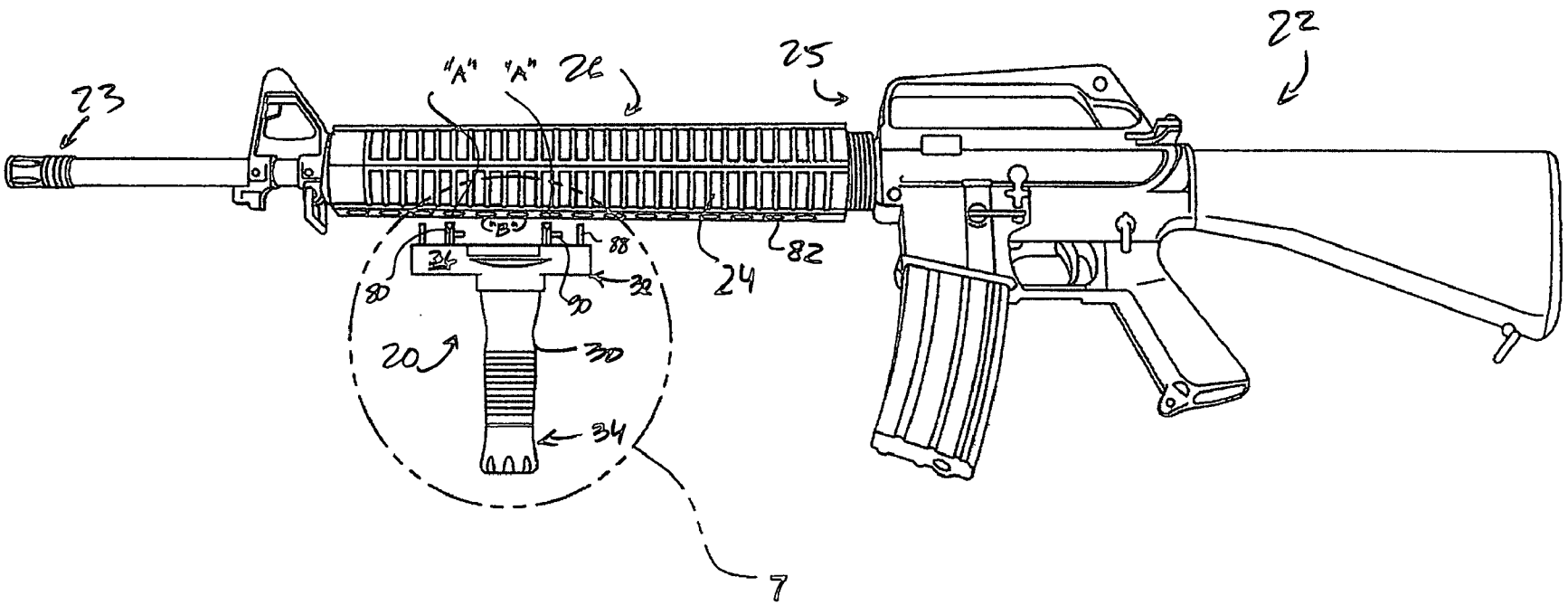
FIG. 6 depicts a weapon with the assembly of FIG. 2 positioned below the forend for aligned receipt of the assembly with a lower portion of the forend.
Figure 14:
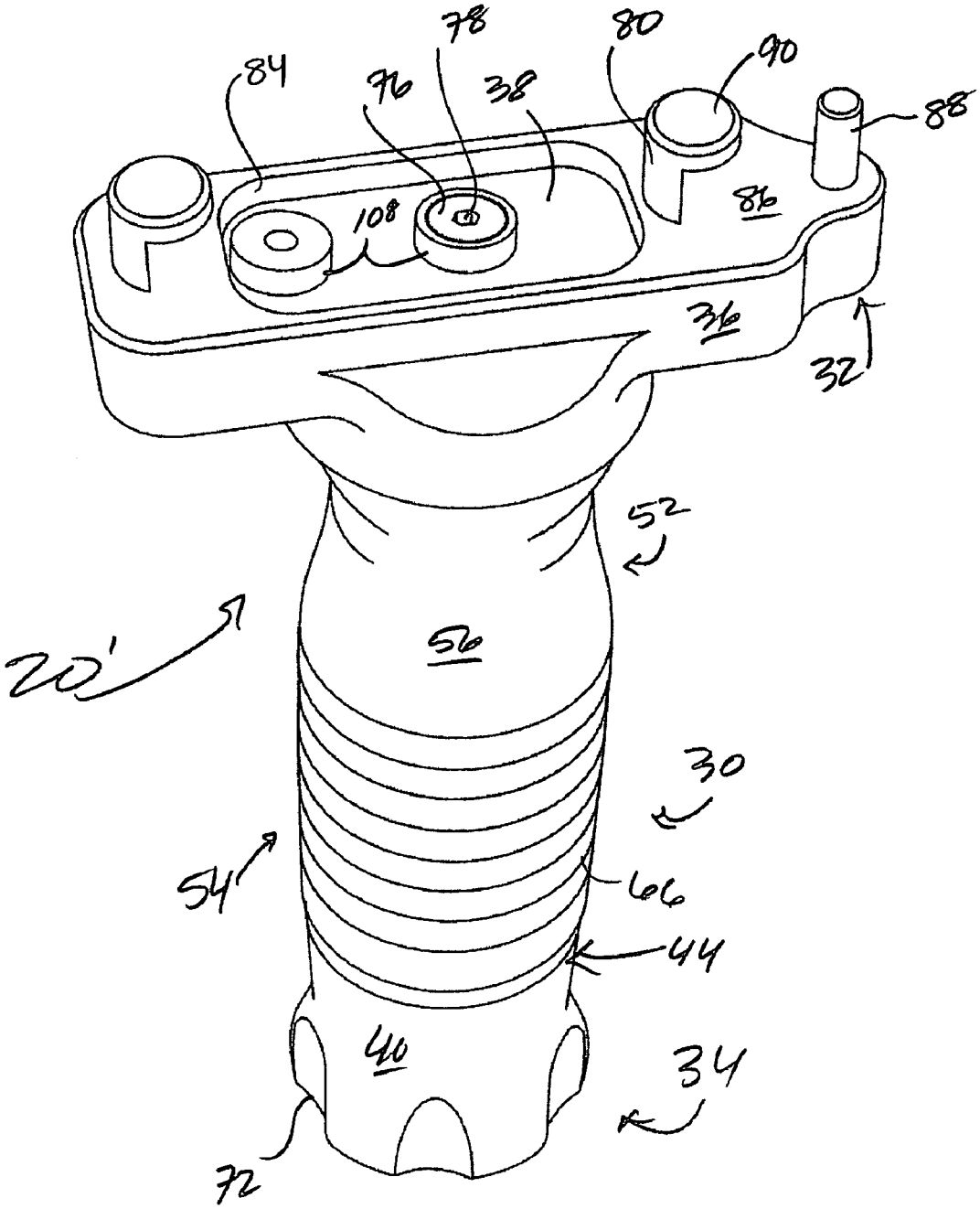
FIG. 14 depicts, in perspective from above and to one side, a further embodiment of the weapon grip of the subject invention, in a readied condition for integration with an unaltered weapon forend.
Figure 15:
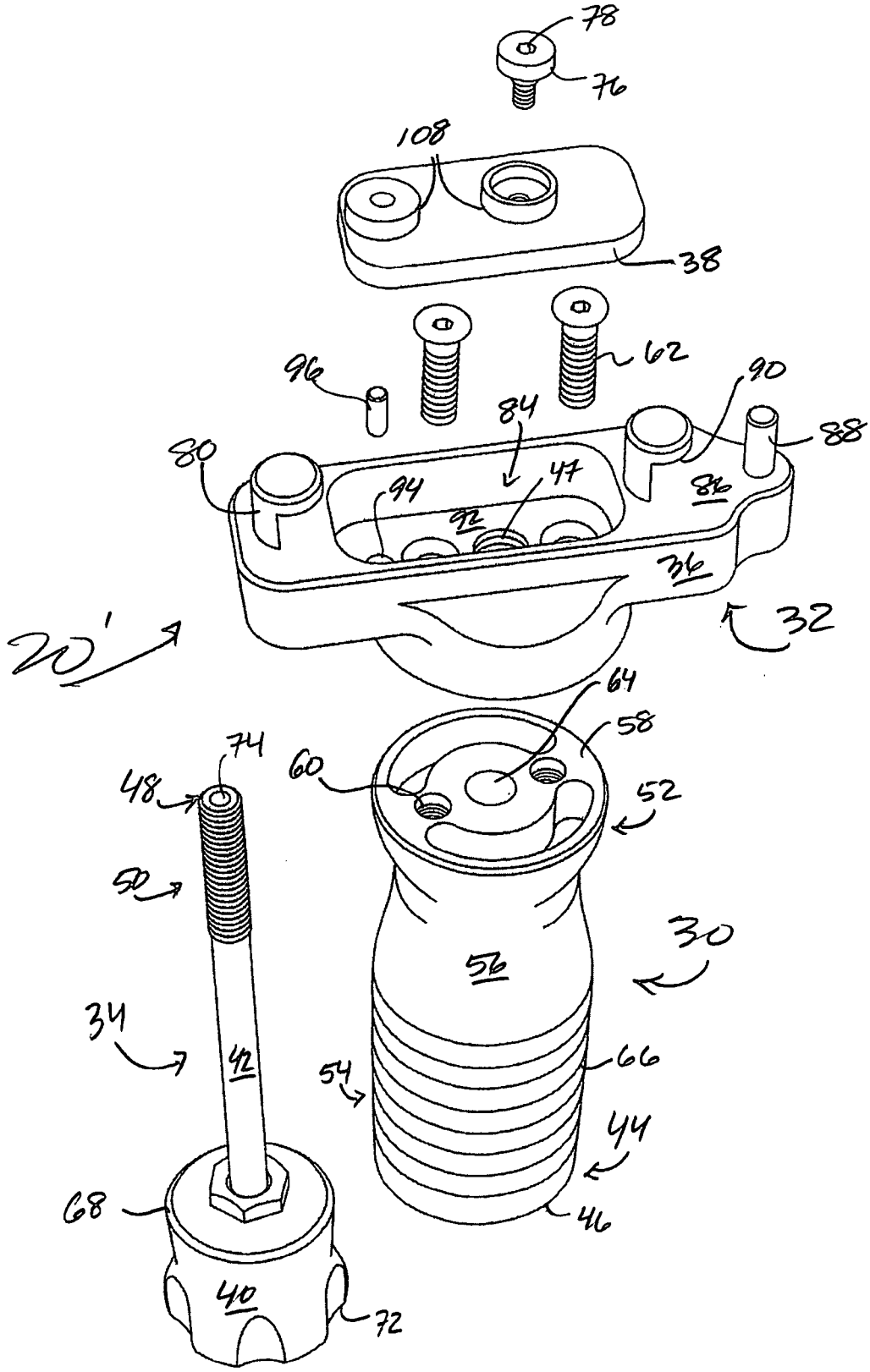
FIG. 15 depicts the assembly of FIG. 14 in exploded perspective, shown from top and to one side.
Figure 16:
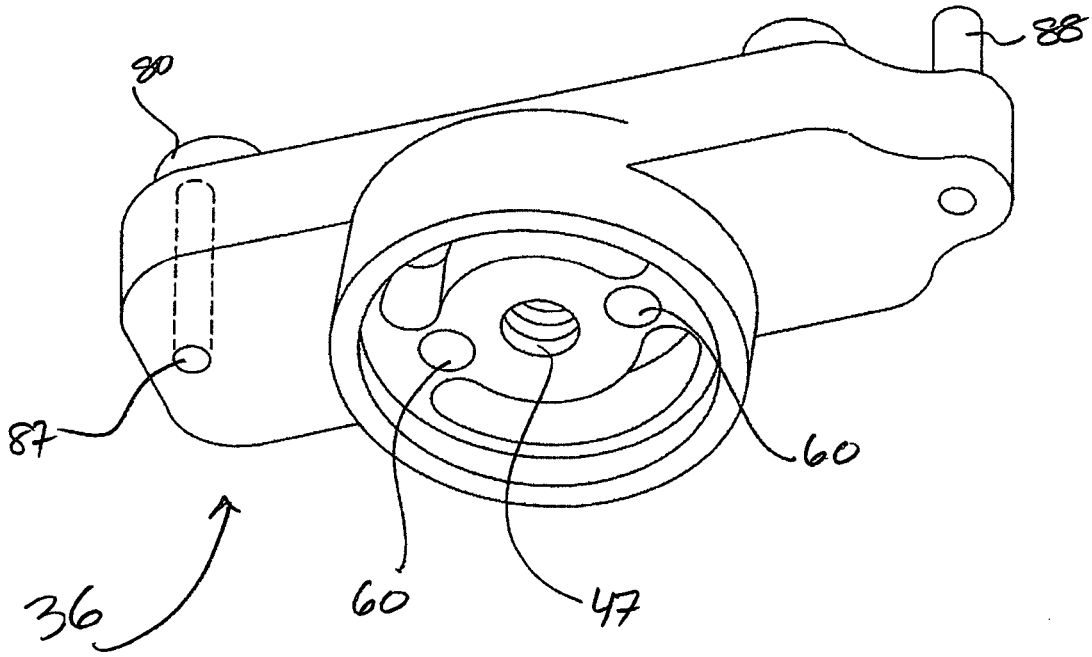
FIG. 16 depicts the mount body of FIG. 15 in perspective, from below and to one side; and, FIG. 17 depicts, in perspective from above and to one side, a further embodiment of the weapon grip of the subject invention, in a readied condition for integration with an unaltered weapon forend.

In as much as the Bushmaster, M16, and HK-G36 assembly embodiments have or include characteristic elements or subassemblies, e.g., a weapon interface and/or a mount body or platform (see/compare FIGS. 2, 14, and 17), a variety of common assembly elements e.g., a preferred, non-limiting actuation mechanism, and/or relationships between elements, e.g., the integration elements for the primary structures of the assembly, are present, and should be readily noted and appreciated (see/compare FIG. 15 with, e.g., FIG. 3). A general overview of the elements or features of the assemblies of FIGS. 2, 14, and 17 follows.

Figure 17:
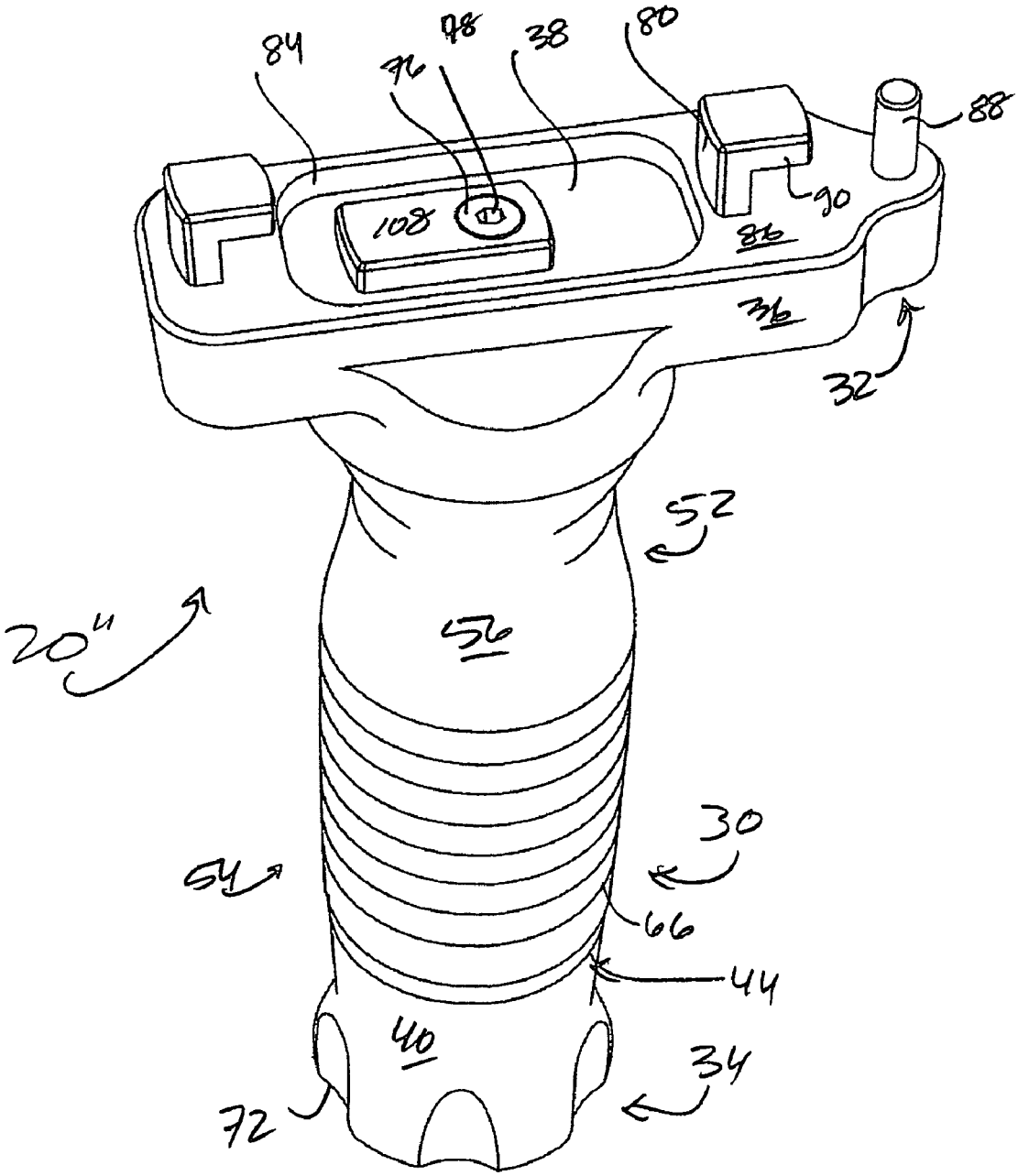

With general reference to the assemblies 20, 20' or 20" of either FIG. 2, FIG. 14, or FIG. 17, the assembly of the subject invention is characterized by, and broadly includes, a handle 30, a weapon interface 32 supported by the handle 30, and an actuator mechanism 34 operatively engageable in furtherance of securely affixing the weapon interface 32 to a lower portion of an unaltered forend, e.g., handguard, of a weapon. Further details of the assemblies of FIG. 2, 14, and 17 are hereafter provided with reference to FIGS. 2-5, FIGS. 14-16, and FIG. 17 respectively, with FIG. 15, an exploded perspective view of the assembly of FIG. 14, illustrating both the relationships between and among the weapon interface 32, handle 30 and actuator 34 on the one hand, and the relationships between and among a mount body 36 and locking structure 38 of the weapon interface 32 on the other hand.

The weapon interface 32 of the assembly 20 (FIGS. 2, 14, or 17) generally includes mount body or platform 36, and actuatable locking structure 38 (e.g., a bar or lug), with the actuator mechanism 38 generally including a control knob 40 and a control rod 42 extending therefrom (see especially, FIGS. 2 and 15). As indicated, the control knob 40 is generally received within a free end portion 44 of the grip 30 so as to at least partially reside therein, i.e., so as to depend from a rim 46 of the free end portion 44 of the handle 30 for user manipulation, more particularly, rotation, in furtherance of reversible attachment of the assembly to the host weapon. The rod 42 of the actuation mechanism 34 generally extends through the grip 30 and threadingly extends through the mount body 36, the actuatable locking plate 38 being threadingly received via bore 47 upon a free end 48 of a threaded portion 50 of the rod 42.

With general reference to FIGS. 3 & 15, the handle 30 of the subject assembly generally depends from the weapon interface 32, more particularly, the mount body 36 (see e.g., FIGS. 2, 3 & 15). The handle 30 includes upper 52 and lower 54 portions, the portions delimited by a taper or waist 56. The upper portion 52 includes an upper surface 58 adapted for integration, e.g., affixation, with the weapon interface 32, more particularly, the mount body 36. The lower portion 54 characteristically includes free end 44 adapted for, among other things, receipt of a portion of the control knob 40. Both interior and exterior features of the handle or grip 30 greatly aid assembly functionality.

In furtherance of integration with mount body 36, the upper end surface 58 of the handle 30 includes at least a single threaded bore 60, two illustrated in FIG. 15, for receipt of a threaded fastener 62 for securing union of the elements. The upper end surface 58 further includes a through hole/bore 64 for receipt of the control rod 42 of the actuator mechanism 34.

Advantageously, the handle is fabricated from a compound chosen for its hardness, tensile strength and environmental resistance, among other desirable characteristics. The handle functions as the prime control element/surface of the assembly, and arguably the host weapon itself, and has a specific shape and features to provide optimum handling characteristics.

Exterior characteristics of the handle, e.g., overall outside diameter and surface finish, are intended to provide maximum user comfort and control. The "bottleneck" contour enhances retention during rough handling by allowing the thumb and index finger to encircle the handle completely. A pattern of indented "rings," e.g., circumferential grooves 66, in the surface of the lower portion 54 of the grip 30 is preferable, but not necessarily provided so as to enhance the user retention during motion in-line with the handle's long dimension. Overall grip length provides optimum hand fit, and protects the user's hand against rough contact with hard surfaces at the bottom of the handle. It is further contemplated to include manufacturer identification of the like in or upon the handle, or elsewhere, for inclusion in civilian and military databases.

Interior characteristics of the handle, e.g., an interior profile thereof, are intended to provide maximum strength, durability and longevity of the handle and/or one or more of the other assembly components, while minimizing weight. The interior profile is generally contoured to match the operating characteristics of the control knob 40, control rod 42 and configuration of the mount body or plate 36.

The interior surface of the lower portion 54 of the handle 30, namely, that portion into which a portion of the control knob 40 is received, is configured and/or sized to allow proper tension to be developed between the knob 40 and the handle 30, a tension further aided via a sealing engagement resulting from, and owning to an o-ring 68 supported by the control knob. The interior surface adjacent the lower peripheral rim 46 of the lower handle portion 54 thereof, is preferably but not necessarily adapted so as to permit select egress of any substance finding its way into the grip therefrom, e.g., accumulated moisture, by "moving," i.e., translating, the control knob to a designated, preselect position within the handle which will allow the interior of the handle to drain freely, while nonetheless maintain the integrity of the assembly while coupled to the host weapon.

With continued reference to FIGS. 3 & 15 and as previously noted, the actuator assembly 34 generally includes control knob 40, equipped with o-ring 68, from which extends control rod 42. The knob 40, which is advantageously fabricated from a compound chosen for its hardness, tensile strength and environmental resistance, among other desirable characteristics, includes a retention groove 70 for receipt of o-ring 68. The knob 40 advantageously, but not necessarily, includes a slotted end face or surface (not shown) to allow operation with/use of a torque amplification aid. The knob 40 further preferably includes a knurled periphery 72 or other such adaptation chosen to provide optimum grip during operation, with and without gloves. The length and profile of the knob are selected for optimum lock bar control to the operator, elimination of component jamming, and damage resistance from hard strikes in any axis.

O-ring 68 of the actuation mechanism 34 functions to, among other things, provide or impart tension between the control knob 40 and the interior of the lower handle portion 54, and thereby maintain the operator select assembly configuration. Furthermore, the o-ring seals the handle/knob interface so as to eliminate entry of airborne and/or fluid contaminants into the cavity of the handle. The o-ring material is selected for its durability and environmental resistance, among other desirable characteristics.

The control rod 42 of the actuation mechanism 34 functionally transfers or converts rotational motion from the users hand, via the knob 40, into vertical motion for the locking plate 38. The control rod 42 includes a threaded bore 74 in a free end portion thereof, more particularly, a free end surface thereof for receipt of a fastener, e.g., shoulder bolt 76 as shown (e.g., FIG. 3 or FIG. 15) which effectively secures the locking plate 38 to/with the control rod 42. The length of the control rod is specifically selected to allow proper operation of the lock bar and the control knob. The control rod material is selected for its tensile strength and other desirable characteristics, and advantageously has undergone a protective anti-corrosion treatment.

Shoulder bolt 76 uniting the locking bar 38 and control rod 42 advantageously includes a hex control slot 78, and is dimensioned specifically to provide the proper operation and interface between the lock bar 38 and the control rod 42. The material of the shoulder bolt is selected because of its tensile strength, corrosion resistance and other desirable characteristics, and advantageously has undergone a protective anti-corrosion treatment.

With particular reference now to FIGS. 2-5, unless otherwise noted, the weapon interface 32 generally includes the mount body or platform 36, and the actuatable locking structure 38 (e.g., a bar or lug as shown), operatively linked to the actuator 34, for reversible extension or advancement from the mount body 36 via operative engagement of the control knob 40 of the actuator 34. As should be readily appreciated with reference to the subject figures, and as will later be detailed in connection with FIGS. 6-10, a quick, no-tools-required, reliable securement is achieved via drawing of a portion of the weapon forend between cooperative structures of the subject assembly.

The mount body 36 of the weapon interface 32 generally includes at least a single stanchion or post 80 for receipt within an aperture 82 of an unaltered forend 26 of the host weapon 22, a central cavity or depression 84 in a surface 86 of the mount body 36 within which the actuatable structure 38 is advanced from (FIG. 2)/retracted into (FIG. 3), and, advantageously, but not necessarily, at least a single stanchion pin 88 adjacent a stanchion 80. Each stanchion or post 80 is advantageously adapted at a free end portion thereof to form an interface with a rim of the aperture within which it is received, as by, for example, by inclusion of a ledge or protuberance 90

The mount body 36, which provides a primary engagement surface for the grip assembly in furtherance of integrating same with a host weapon, advantageously includes a pair of identically configured posts 80 which upwardly extend from the surface 86 thereof. The posts 80 are spaced to produce optimum engagement of the subject assembly to the unaltered forearm of the host weapon, while allowing for manufacturing tolerances between and among the multiple manufacturers of such forearms. The illustrated, non-limiting engagement profile for the mount body 36 is especially advantageous to insure a solid, and strong connection between the forearm 26 and the assembly 20. It should be readily appreciated that post 80 spacing also determines the overall length of mount body 36. Furthermore, the spacing of the posts 80 contributes to the size/weight of the assembly 20, and dictates the range of longitudinal placement upon an apertured forend.

Figure 10:
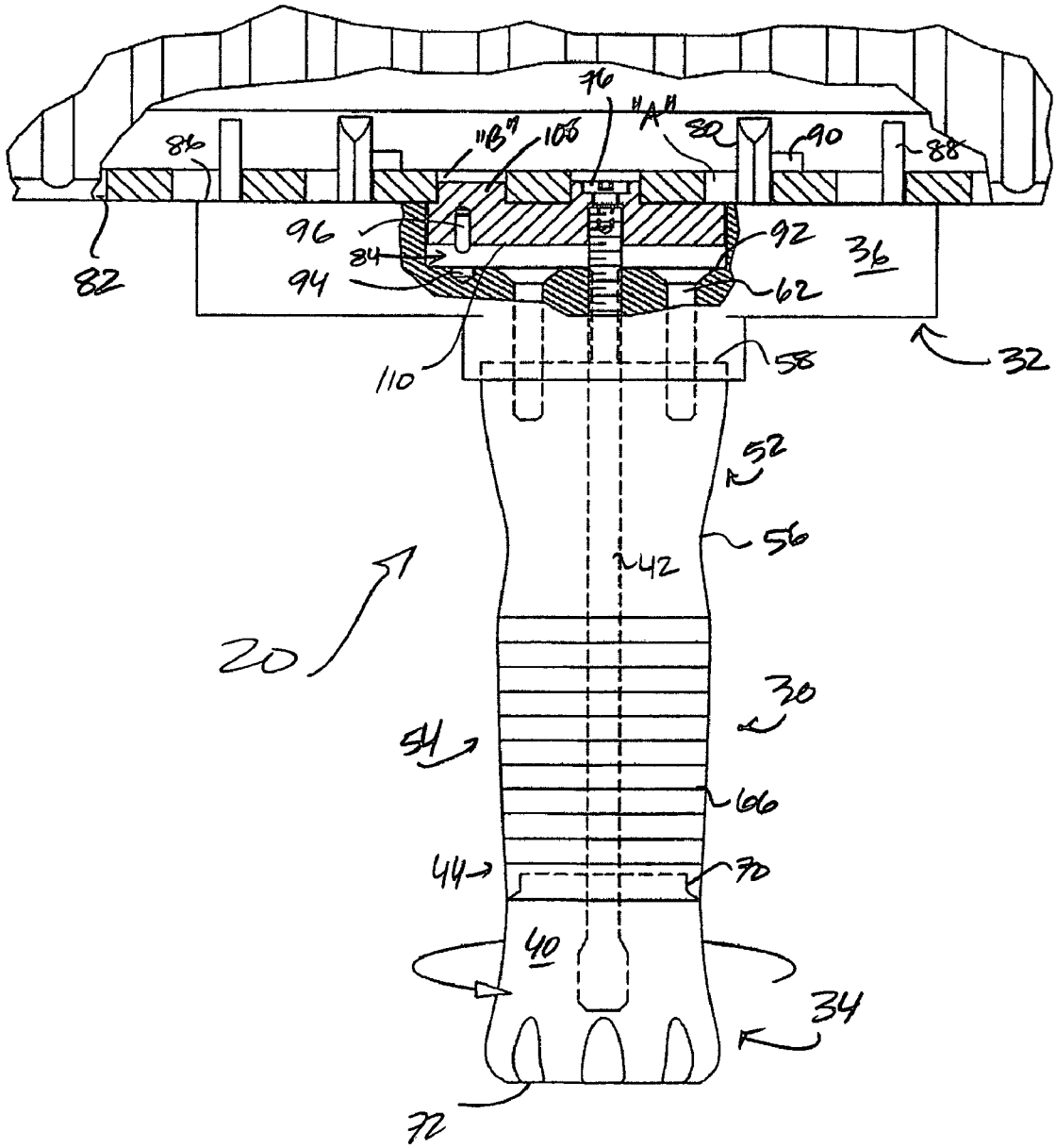
FIG. 10 is fragmentary side elevation of the articles of FIG. 6 depicting a further, subsequent registered arrangement for and between the assembly in relation to the forend, more particularly, a secure interference fit between the assembly and the forend.

Overall post height is selected to produce optimum engagement of the forearm by the posts, without interference with structures generally housed or contained within the forearm, structures which vary among multiple manufacturers (FIG. 10). Post width is selected to provide optimum insertion clearance within the apertures of the forearm (e.g., FIG. 8) which vary in shape/diameter between and among multiple manufacturers. The thickness and profile of the posts are selected to provide optimum fit to the weapon forearm while maximizing the strength of the post structure. The thickness of the post ledge 90, and its clearance with the upper surface of the mounting plate 36, are selected to provide maximum strength for the mount body and optimize the fit of the post within the weapon forearm while providing maximum strength to the post.

The profile of the interior edge of the post ledge 90 is selected to assure an optimum fit of the post to the weapon forearm (e.g., FIG. 9) while minimizing interference with structures contained within the rifle forearm. The upper edge profiles of the post ledge 90 are selected to maximize resistance to damage from rough handling and ensure proper engagement of the post ledge to apertures of the weapon forearm. The upper edge profiles of the post are likewise selected to maximize resistance to damage from rough handling and ensure proper engagement with apertures of the weapon forearm.

The mount body cavity 84 is generally positioned to optimize the relationship between the handle 30 and the mount body 36. The size, shape and profile of the cavity 84 are adaptable to match the shape and profile of the locking bar 38 (i.e., compare those of FIGS. 12, 14, and 17), and to minimize entry of contaminants into the cavity during normal operations. Furthermore, the body cavity 84 includes a bottom surface 92 contoured to accept the nesting profile of the locking bar (FIG. 7), more particularly, the bottom surface cavity floor 92, as shown, includes a dimple or relief 94 for a pin dependance from the locking structure 38.

The mount body or plate advantageously includes stanchion pins, more particularly, either an internal stanchion pin or pins 87, an external stanchion pin or pins 88 (FIGS. 2-5), or, as the case may be, a combination of internal and external stanchion pins (FIG. 16). The "internal" post pin 87 is a reinforcing structure which fortifies the "forward" stanchion 80 (FIGS. 14-16). The type, size and location of this pin 87 is carefully selected to enhance the overall performance of the assembly, and, more particularly, maintain the functionality of the post. The pins are intended to protect the stanchions from damage during rough handling. The pin material is selected for its strength and the pin has a protective finish coating. The pin is inserted during manufacture and is not removable or serviceable.

The "external" post pin 88 (see, e.g., FIG. 14-16 for a single pin; FIGS. 2-5 for a pair of pins, each adjacent a post 80 of the pair of posts) is a protective structure which protects the "rearward" post 80 from damage during rough handling. The type, size and location of this pin, generally adjacent the post 80 and intermediate it and free end of the mount body 36, is carefully selected to enhance the overall performance of the assembly, and, more particularly, maintain the functionality of the post. The pin material is selected for its strength and the pin has a protective finish coating. The pin, as shown, is inserted during manufacture and is not serviceable or removable. It is to be appreciated that the platform may alternately include two internal or two external pins, no pins, or other combinations.

Figure 11:
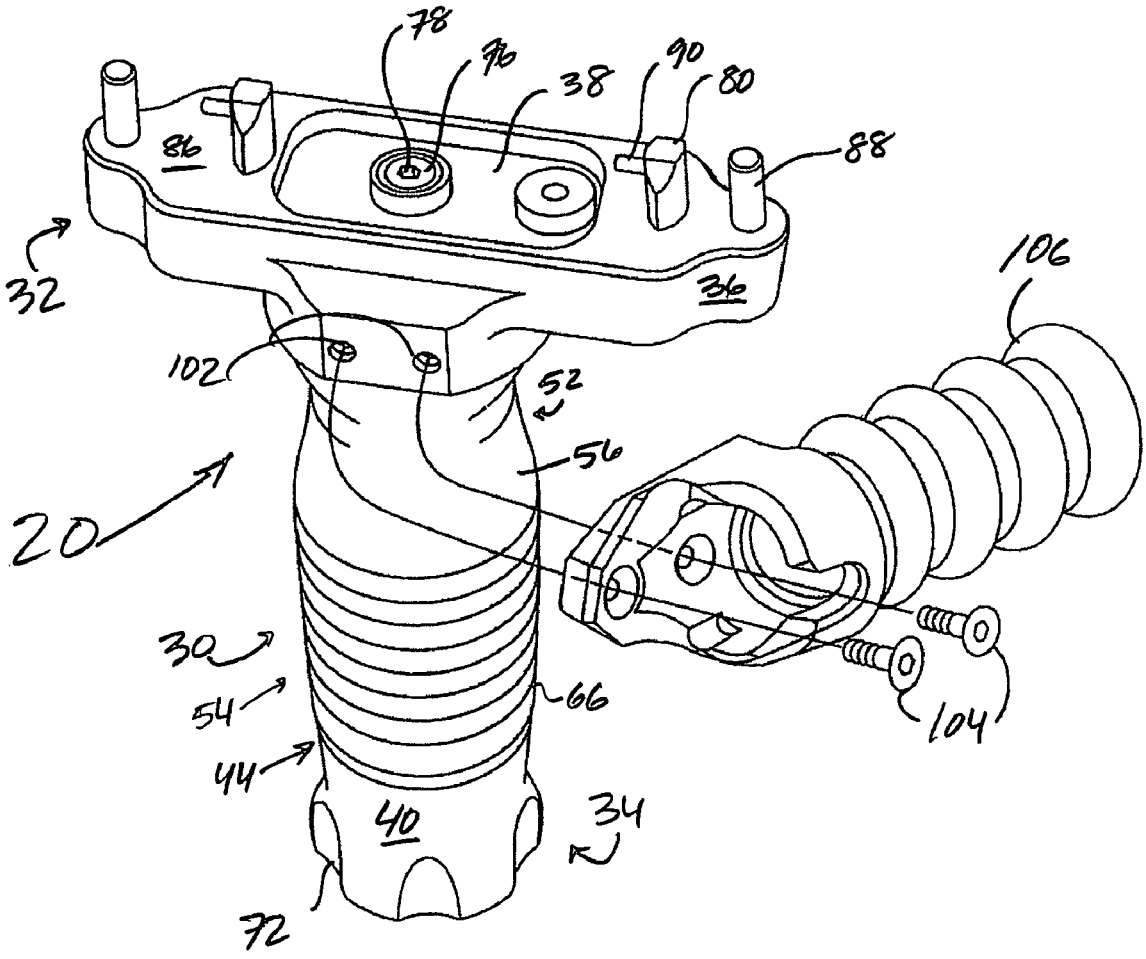
FIG. 11 depicts the assembly of FIG. 2 adapted for receipt of a target illumination device.
Figure 12:
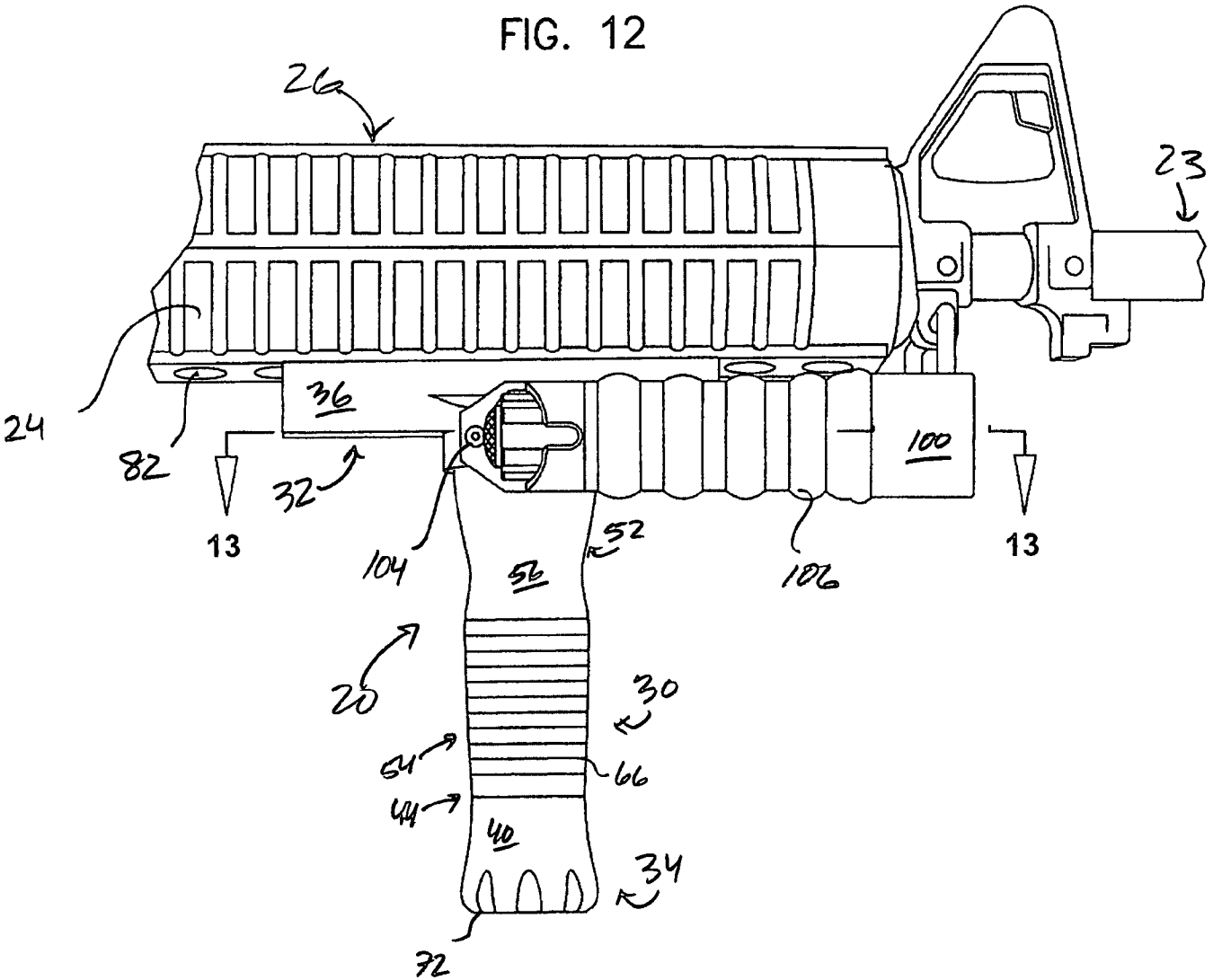
FIG. 12 depicts a weapon, more particularly a forend thereof in part, the combination of FIG. 11 integrated therewith.
Figure 13:
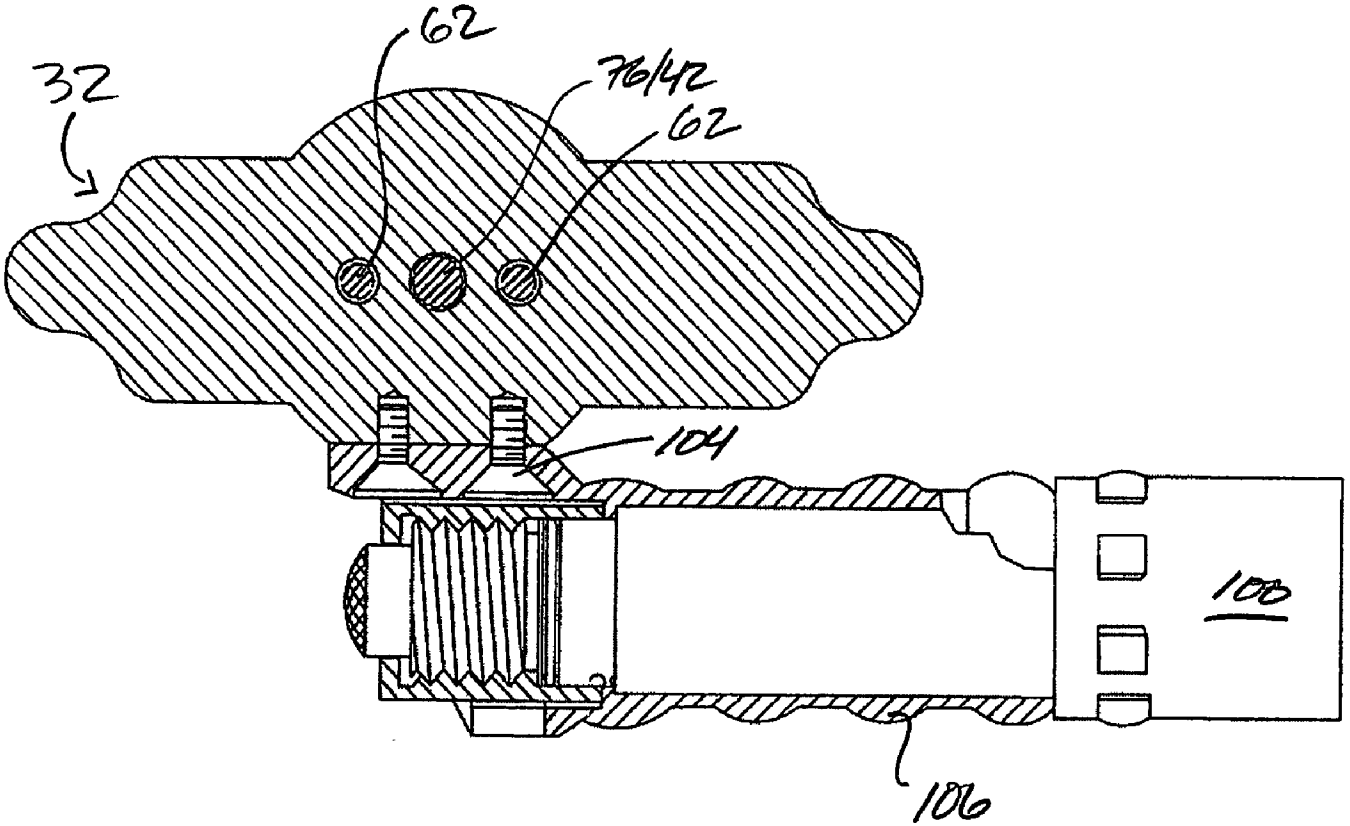
FIG. 13 is a top plan section of the combined assembly taken along line 13-13 in FIG. 12.

As should be readily appreciated with reference to FIGS. 11-13, the mount body or plate 36 may be readily adapted as shown, or otherwise adapted, to support attachment of, or include a personal illumination tool 100. Such tools, devices and/or mounting structures are well known, with that shown subject of Applicant's copending international patent application ser. no. PCT/US2005/039079 (WO 2006/050163), incorporated herein by reference in its entirety.

Target illumination, or other functionality, may be integral formed, or after added (i.e., user selected) via slight alteration the side profile of the mount body 36, or the addition of threaded holes 102 (FIG. 11) to receive fasteners 104 for an accessory holder 106, as shown, respectively. As is described in Applicant's cited copending international application, portable illumination tool 100 (FIGS. 12 & 13) is readily received in the mounting structure 160, and integrally formed therein so as to form an interference fit between portions of the mounting structure 106 and portions of the illumination tool 100.

The configuration of the mount body 36 generally permits supporting attachment of a standard P-rail, not shown, which will allow attachment of a variety of accessories to the subject assembly to compliment the utility thereof. As with the illumination tool, this detail can be added at manufacture by adding two threaded holes to receive the P-rail machine screws, and by slightly altering the side profile of the mount plate. Both the illumination tool accessory, and/or the P-rail accessory can be attached to the subject assembly at the same time, each being necessarily located on a different, i.e., opposing, side of the mount body.

Figure 9:
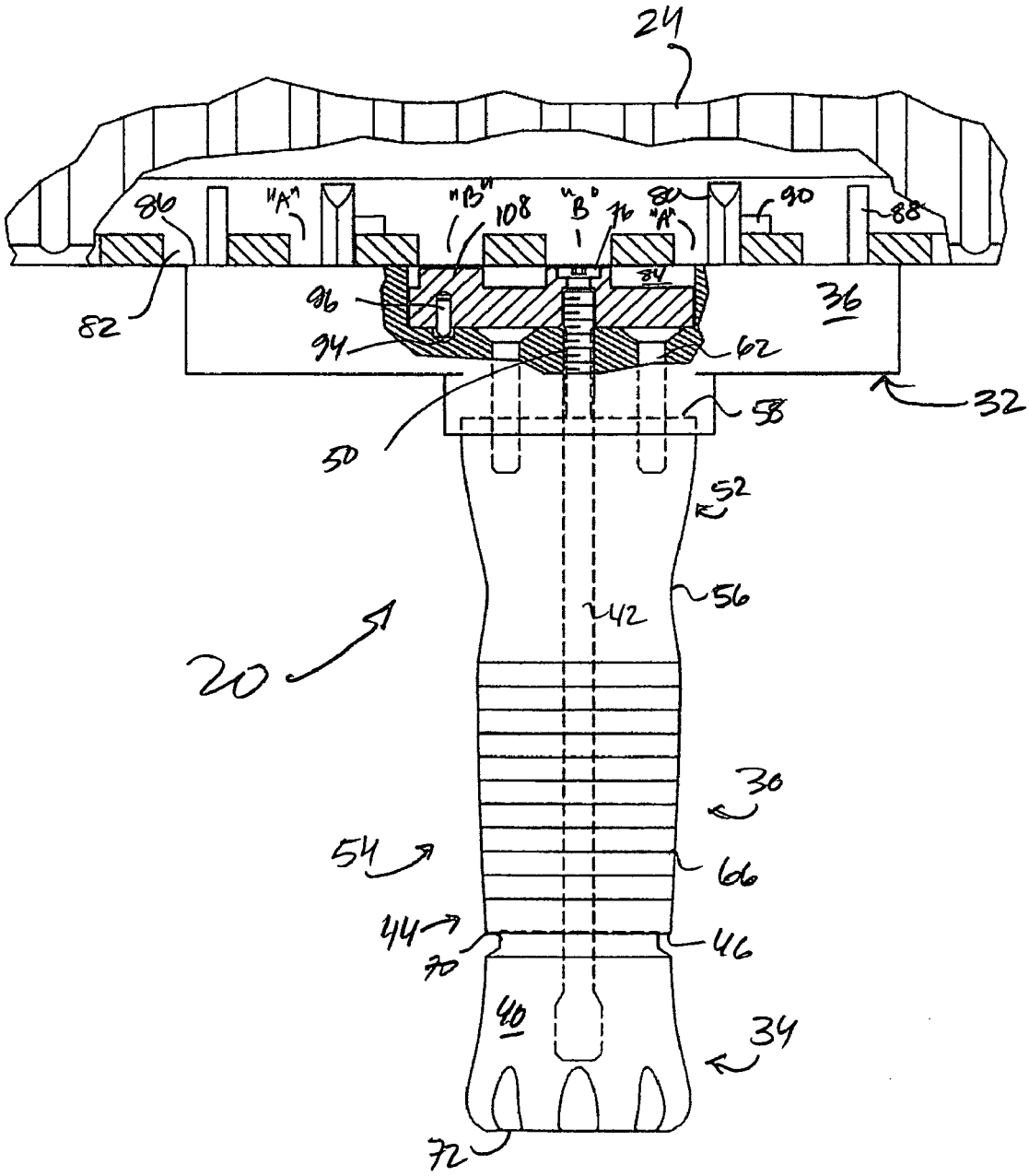
FIG. 9 is fragmentary side elevation of the articles of FIG. 6 depicting a further, subsequent aligned interferring arrangement for the assembly in relation to the forend.

Referring again primarily to FIGS. 3-5, and selectively to FIGS. 14 and 17, the actuatable lock 38 of the weapon interface 32 generally includes a surface adapted for mating engagement with, i.e., registered receipt within, at least a single aperture of the unaltered forend, more particularly, for registration/receipt within at least a single aperture intermediate the post receiving apertures thereof (see e.g., FIG. 9). In connection to the locking structure 38 of the weapon interface 32 of FIGS. 2 & 14, a pair of spaced apart lugs, pegs, plugs, etc 108. extend therefrom for registration with a pair of spaced apart apertures of the forend (e.g., FIG. 9), and actuated engaged receipt of the lugs 108 with/into the apertures (e.g., FIG. 10). Advantageously, a lug 108 of the locking structure 38 is adapted to receive a fastener, more particularly, shoulder bolt 76 (FIG. 3 or 15) in furtherance of securing the structure 38 to the control rod 42 of the actuator mechanism 34.

The lower surface of the lock structure advantageously includes an integral protruding element, e.g., pin 96 (see e.g., FIGS. 3 & 15) which limits side-to-side or rotational travel (i.e., pivoting) when the lock structure 38 is raised out of the mount body cavity 84, i.e., beyond the surface 86 of the mount body 36. As previously discussed, the position of the lock bar 38 is varied by operating the control knob 40. The lock bar 38 may be raised fully out of the cavity 84 to allow the user to easily flush any contaminants that may have entered. The lock bar 38 has a large radius all around a lower surface 110 thereof, i.e., lower peripheral edge or rim, to ensure quick and easy re-alignment with the cavity 84 when closing, i.e., retracting, from the extended pivoted cleaning position.

The lock structure provides the ability to positively lock the assembly to the unaltered forearm of the host weapon. When the lock bar is in an engaged, advanced or extended position (i.e., the lug or lugs 108 thereof registeringly received in one or more apertures of the forend as the case may be, with it thereafter impossible to remove the two stanchions from their engaged relation with adjacent apertures of the forend. The collaborative contact between structure of the weapon interface, initiated and maintained via actuation of the actuation mechanism, assures that the assembly of the subject invention, and all its variants, will stay locked in place.

With particular reference now to FIGS. 6-10 the functionality of the subject assembly, more particularly, the assembly of FIGS. 2-5 is illustrated. With a configuration for the assembly as FIG. 2, namely, in a readied condition for integration with an unaltered weapon forend, the locking structure 38 is retracted at least to the point wherein the lugs 108 thereof are within the cavity 84 of the mount body 36. A preferred non-limiting orientation for the assembly of FIG. 2 is that shown in FIG. 6, namely, with the ledges 90 of the posts 80 generally facing away from the muzzle end 23 of the weapon 22 or such that translation of the assembly 20 is toward the user or breech 25 of the weapon 22.

Figure 7:
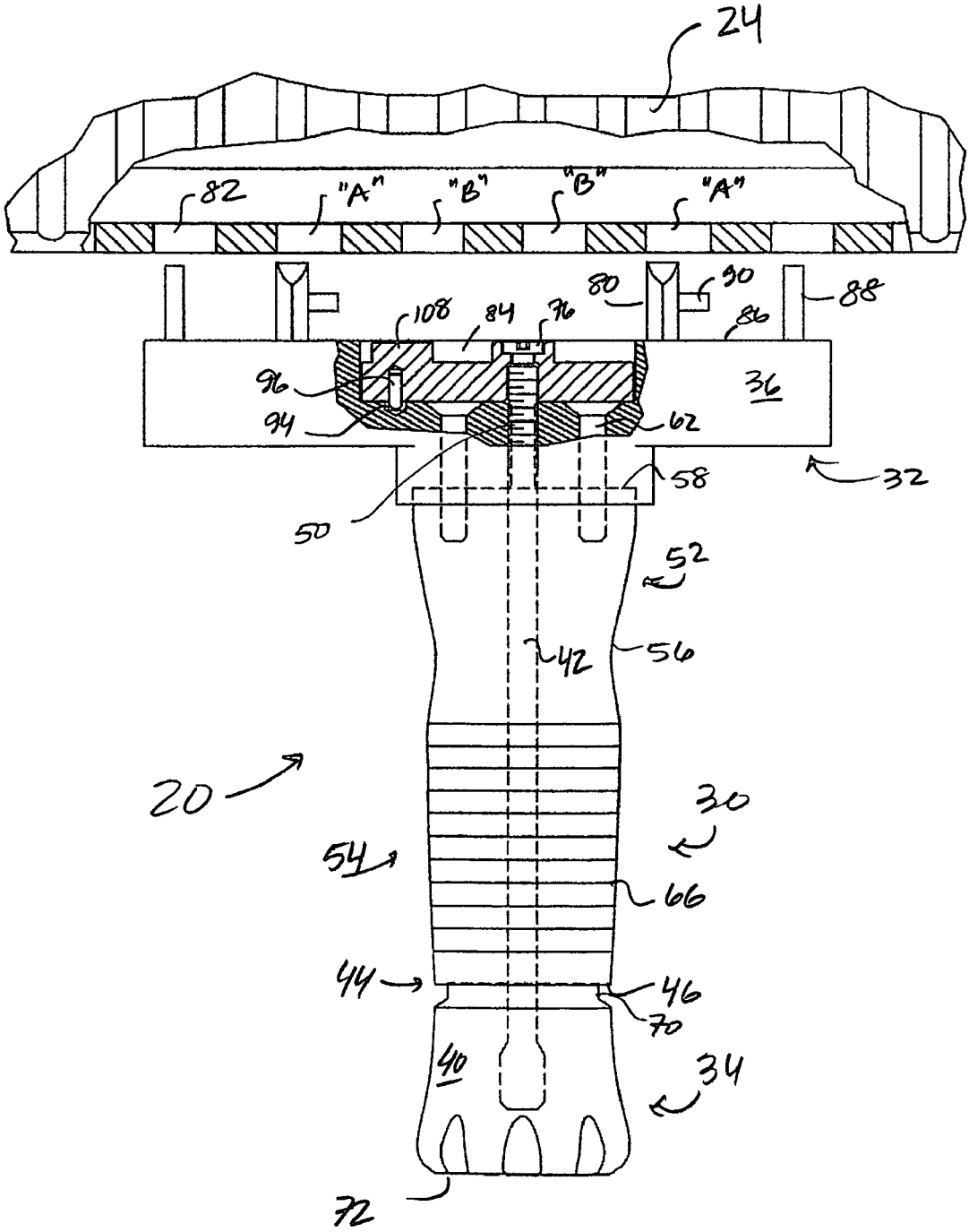
FIG. 7 is fragmentary side elevation of the articles of FIG. 6 depicting an initial aligned arrangement for the assembly in relation to the forend, more particularly, spaced apart apertures thereof.
Figure 8:
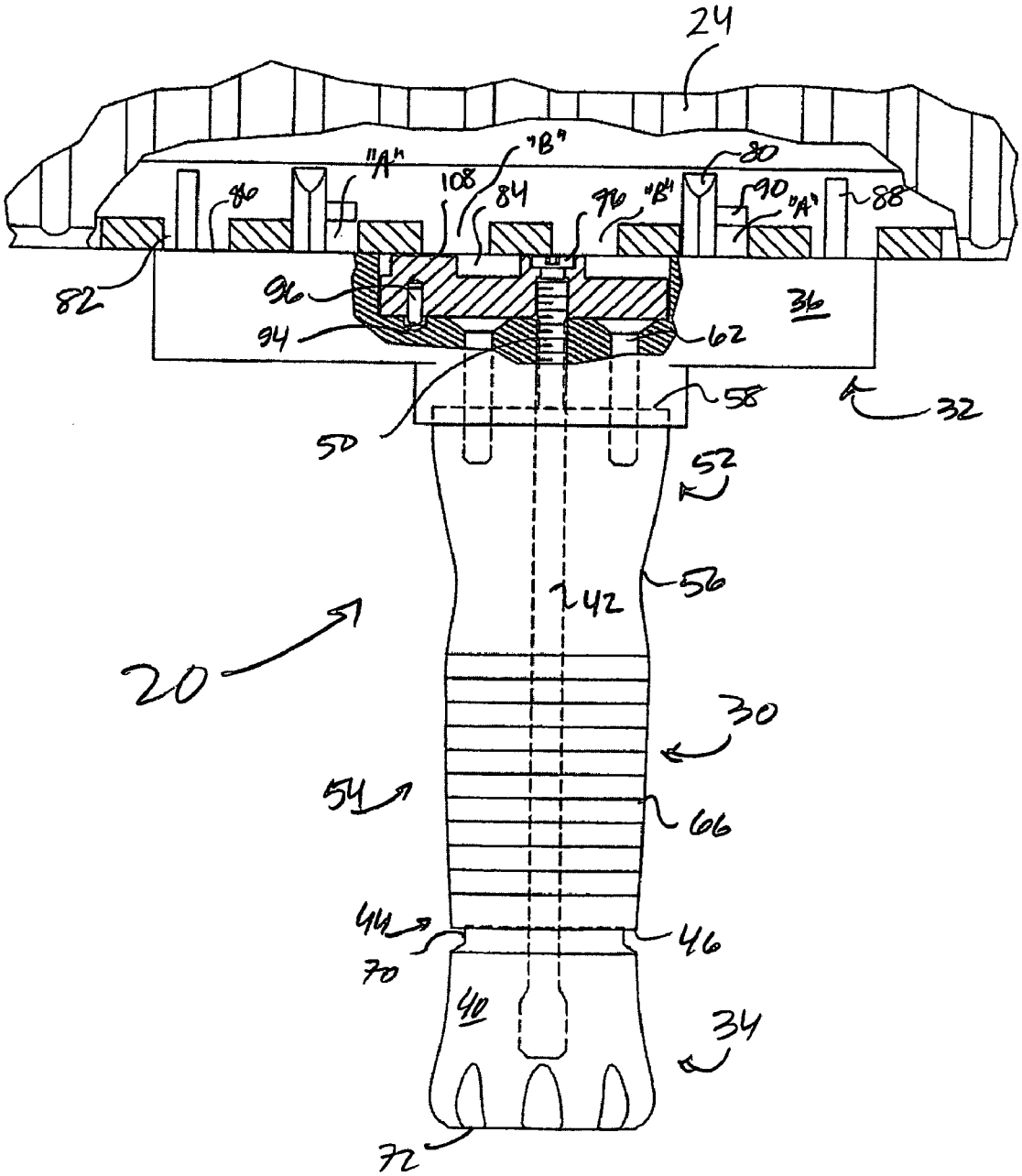
FIG. 8 is fragmentary side elevation of the articles of FIG. 6 depicting an initial registered arrangement for and between the assembly in relation to the forend.

As is best seen with reference to FIG. 7, the assembly 20 is generally aligned below the forend such that the posts 80 of the mount body 36 are registerable within spaced apart apertures "A" of the unaltered forend 26 of the host weapon 22. Thereafter, as illustrated in FIG. 8 the posts 80 are readily receivable within the target apertures "A". In the arrangement as shown, the mount body 36 is in substantial engagement with a segment of the unaltered forend 26. Thereafter, the assembly is translated rearward to form an interference fit for the weapon interface 32 and the unaltered forend 26 of the weapon 22, more particularly, an interference fit between the posts 80 of the mount body 36 and rim portions of the forend apertures "A" within which the posts 80 are received. As is readily appreciated with reference to FIG. 9, such an interference fit essentially registers the lugs 108 of the locking structure 38 with apertures "B" of the unaltered forend 26 which are intermediate those (i.e., apertures "A") within which the posts 80 have been received. Finally, with such quick and sure alignment, the control knob 40 is rotated, e.g., as indicated in FIG. 10, the control rod 42 advancing through the mount body 36 such that the locking structure 38 advances, more particularly, the lug/lugs 108 advance for receipt within the registered apertures "B" for same. Via the quick and sure engagement of the control knob 40, portions of the unaltered forearm are drawn between portions of the mount body 36 and locking lug 108 thereby creating a supremely tight interface obtained via efficient cooperation of elements of the subject assembly.

There are other variations of the subject invention, some of which will become obvious to those skilled in the art. It will be understood that this disclosure, in many respects, is only illustrative. As should be readily appreciated, the nature or style of the locking bar tab, and the specifics of the posts, more generally, the surface configuration for the mounting plate, are variable, their details dictated by the nature of the host weapon, however, such variants are considered species of the heretofore disclosed genus. Finally, changes may be made in details, particularly in matters of shape, size, material, and arrangement of parts, as the case may be, without exceeding the scope of the invention. Accordingly, the scope of the subject invention is as defined in the language of the appended claims.

That which is claimed:

1. A weapon grip assembly for mating with a weapon without tools, said assembly comprising a handle, a weapon interface supported by said handle, and an actuator operatively engageable in furtherance of securely affixing said weapon interface to a lower portion of an unaltered handguard of the weapon, said weapon interface comprising a mount body and an actuatable locking structure reversibly extendible from said mount body via operative engagement of said actuator, said mount body including stanchions for receipt within spaced apart apertures of the lower portion of an unaltered handguard wherein said at least a single stanchion of said stanchions is structurally reinforced via an internal reinforcing stanchion pin.

2. The weapon grip assembly of claim 1 wherein said mount body further includes an external stanchion pin adjacent a stanchion of said stanchions.

3. The weapon grip assembly of claim 1 wherein said mount body further includes external stanchion pins, each external stanchion pin of said external stanchion pins adjacent a stanchion of said stanchions.

4. The weapon grip assembly of claim 1 wherein said mount body includes surface characterized by a cavity, said actuatable locking structure reversible advanceable therefrom.

5. The weapon grip assembly of claim 1 wherein said mount body is adapted to support a personal illumination tool.

6. The weapon grip assembly of claim 1 in operative combination with a personal illumination tool, said personal illumination tool supported by said mount body.

7. The weapon grip assembly of claim 1 in operative combination with an accessory holder, said accessory holder supported by said mount body.

8. The weapon grip assembly of claim 7 in operative combination with a personal illumination tool, said personal illumination tool supported by said accessory holder.

9. The weapon grip assembly of claim 1 wherein said actuatable locking structure includes a surface adapted for mating engagement with at least a single aperture of spaced apart apertures of the lower portion of an unaltered handguard.

10. The weapon grip assembly of claim 1 wherein said actuatable locking structure includes a portion adapted for registered receipt within at least a single aperture of spaced apart apertures of the lower portion of an unaltered handguard.

11. The weapon grip assembly of claim 1 wherein said actuatable locking structure comprises an upstanding lug for registered receipt within an aperture of spaced apart apertures of the lower portion of an unaltered handguard.

12. The weapon grip assembly of claim 1 wherein said actuatable locking structure includes spaced apart upstanding lugs for registered receipt within adjacent apertures of spaced apart apertures of the lower portion of an unaltered handguard.

13. The weapon grip assembly of claim 1 wherein said stanchion includes a free end adapted to form an interface with a rim of an aperture of spaced apart apertures of the lower portion of an unaltered handguard within which it is receivable.

14. The weapon grip assembly of claim 1 wherein said stanchion includes a free end characterized by a ledge for forming an interface with a rim of an aperture of spaced apart apertures of the lower portion of an unaltered handguard within which it is receivable.

15. The weapon grip assembly of claim 1 wherein said stanchion includes a free end characterized by a protuberance for forming an interface with a rim of an aperture of spaced apart apertures of the lower portion of an unaltered handguard within which it is receivable.

16. The weapon grip assembly of claim 1 wherein said handle includes upper and lower portions delimited by a taper.

17. The weapon grip assembly of claim 1 wherein said handle includes an upper surface adapted for affixation with said weapon interface.

18. The weapon grip assembly of claim 1 wherein said handle includes a surface characterized by spaced apart circumferential grooves.

19. The weapon grip assembly of claim 1 wherein said handle includes a lower portion having a surface characterized by spaced apart circumferential grooves.

20. The weapon grip assembly of claim 1 wherein said actuator comprises a knob from which extends a rod, a free end of said rod united with said actuatable locking structure, said handle and said weapon interface positioned intermediate said knob and said actuatable locking structure about said rod.

21. The weapon grip assembly of claim 1 wherein said actuator comprises a knob operatively linked to said actuatable locking structure.

22. The weapon grip assembly of claim 1 wherein said actuator comprises a knob operatively linked to said actuatable locking structure, said knob including a surface adapted for receipt of a torque amplification aid.

23. The weapon grip assembly of claim 1 wherein said actuator comprises a knob operatively linked to said actuatable locking structure, said knob including a knurled periphery.

24. The weapon grip assembly of claim 1 further comprising a control rod, said control rod operatively linking said actuator to said actuatable locking structure.

* * * * *